US011304272B2

(12) United States Patent
Chang et al.

(10) Patent No.: US 11,304,272 B2
(45) Date of Patent: Apr. 12, 2022

(54) LIGHTING SYSTEM AND CONVERSION CONTROLLER CIRCUIT THEREOF

(71) Applicant: RICHTEK TECHNOLOGY CORPORATION, Zhubei (TW)

(72) Inventors: Wei-Hsu Chang, Hsinchu (TW); Chang-Yu Wu, Hsinchu (TW)

(73) Assignee: RICHTEK TECHNOLOGY CORPORATION, Zhubei (TW)

( * ) Notice: Subject to any disclaimer, the term of this patent is extended or adjusted under 35 U.S.C. 154(b) by 112 days.

(21) Appl. No.: 16/844,947

(22) Filed: Apr. 9, 2020

(65) Prior Publication Data

US 2021/0029791 A1 Jan. 28, 2021

(30) Foreign Application Priority Data

Jul. 25, 2019 (TW) ..... 108126412

(51) Int. Cl.

| | |
|---|---|
| ***H05B 45/10*** | (2020.01) |
| ***H05B 47/19*** | (2020.01) |
| ***H05B 45/375*** | (2020.01) |
| ***H05B 45/382*** | (2020.01) |
| ***H05B 45/38*** | (2020.01) |
| ***H05B 45/385*** | (2020.01) |
| *H05B 45/3725* | (2020.01) |
| *H05B 45/395* | (2020.01) |

(52) U.S. Cl.

CPC ..... *H05B 45/10* (2020.01); *H05B 45/375* (2020.01); *H05B 45/38* (2020.01); *H05B 45/382* (2020.01); *H05B 45/385* (2020.01); *H05B 47/19* (2020.01); *H05B 45/3725* (2020.01); *H05B 45/395* (2020.01)

(58) Field of Classification Search

CPC ..... H05B 45/00; H05B 45/39; H02M 1/007

See application file for complete search history.

(56) References Cited

U.S. PATENT DOCUMENTS 10,096,964 B1 * 10/2018 Abdelhalim ..... H01S 3/0912
2013/0063042 A1 * 3/2013 Bora ..... H05B 45/20 315/292

(Continued)

*Primary Examiner* — Amy Cohen Johnson
*Assistant Examiner* — Jianzi Chen
(74) *Attorney, Agent, or Firm* — Tung & Associates

(57) ABSTRACT

A lighting system includes: a power supply circuit, an AC-DC converter circuit and a wireless communication module. The wireless communication module receives an external command from a wireless communication device and generates an adjustment command according to the received external command. The adjustment command includes a luminance adjustment command and a driving power control command. The power supply circuit includes a power stage and a conversion controller circuit. The conversion controller circuit supplies a adjustable output voltage to the wireless communication module, to power the wireless communication module. The conversion controller circuit controls the power stage according to the luminance adjustment command, to adjust an output current of an output power, thereby adjusting the luminance of a light emission device. And, the conversion controller circuit controls the adjustable output voltage according to the driving power control command, to regulate the adjustable output voltage to a high voltage level or a low voltage level.

20 Claims, 10 Drawing Sheets

(56) References Cited

U.S. PATENT DOCUMENTS

2014/0361701 A1* 12/2014 Siessegger ..... H05B 45/382
315/200 R
2014/0370943 A1* 12/2014 Suhonen ..... H04W 52/028
455/574

* cited by examiner

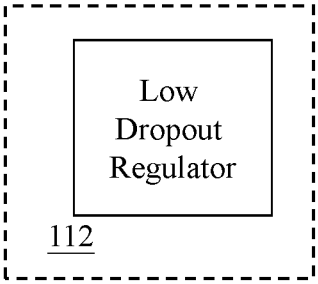
Fig. 9A
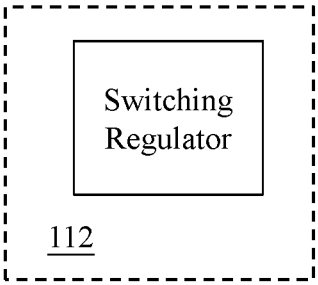
9B

LIGHTING SYSTEM AND CONVERSION CONTROLLER CIRCUIT THEREOF

CROSS REFERENCES

The present invention claims priority to TW 108126412 filed on Jul. 25, 2019.

BACKGROUND OF THE INVENTION

Field of Invention

The present invention relates to a lighting system; particularly, it relates to such lighting system capable of respectively adjusting the luminance of a light emission device and the power required for a wireless communication module. The present invention relates also to a conversion controller circuit for use in the lighting system.

Description of Related Art

A conventional smart lighting system typically includes a wireless communication module, so that the luminance of a light emission device can be remotely controlled via a cell phone or a tablet computer.

Various prior art smart lighting systems are known, such as those disclosed in the following U.S. patents or U.S. Patent Publications: U.S. Pat. Nos. 9,924,575, 6,762,570, 9,313,851, U.S. Patent Publication No. 2010/0084984 and U.S. Patent Publication No. 2013/0221875.

After the luminance of the light emission device is adjusted, usually a user will maintain such luminance for a period of time, but, although the wireless communication module does not need to keep transmitting commands from the cell phone or the tablet computer to the smart lighting system in this period, the wireless communication module still remains at an active operation mode. In fact, after the luminance of the light emission device is adjusted, the wireless communication module can enter into a standby mode, thereby saving power.

In view of this, a novel lighting system is required wherein after the luminance of the light emission device is adjusted, the wireless communication device of this novel lighting system can enter into a standby mode, thereby saving power.

SUMMARY OF THE INVENTION

From one perspective, the present invention provides a lighting system, which is configured to operably supply an output power to a light emission device; the lighting system comprising: a power supply circuit, which is coupled to the light emission device and which is configured to operably receive an input power and operably convert the input power to the output power; an AC-DC converter circuit, which is coupled to the power supply circuit and which is configured to operably receive an AC power and operably convert the AC power to the input power; and a wireless communication module, which is coupled to the power supply circuit via a communication interface and which is configured to operably receive an external command from a wireless communication device via a wireless communication means, wherein the wireless communication module is configured to operably generate an adjustment command according to the external command or according to a power requirement of the wireless communication module, and wherein the wireless communication module is configured to operably transmit the adjustment command to the power supply circuit via the communication interface; wherein the adjustment command includes a luminance adjustment command and/or a driving power control command; wherein the power supply circuit includes: a power stage including at least one power switch, wherein the power stage is configured to operably convert the input power to the output power; and a conversion controller circuit, which is configured to operably receive the input power and convert the input power to a adjustable output voltage, wherein the adjustable output voltage is supplied to the wireless communication module to power the wireless communication module, and wherein the conversion controller circuit is configured to operably generate a switching signal for controlling the at least one power switch to generate the output power; wherein the conversion controller circuit is configured to operably control the power stage according to the luminance adjustment command, to adjust an output current of the output power, thereby adjusting a luminance of the light emission device and/or controlling the light emission device to be ON/OFF; wherein the conversion controller circuit is configured to operably control the adjustable output voltage according to the driving power control command, to regulate the adjustable output voltage to a high voltage level or a low voltage level; wherein a power consumption of the wireless communication module when operating under the low voltage level is smaller than a power consumption of the wireless communication module when operating under the high voltage level.

In one embodiment, the driving power control command includes: voltage level information which is related to the adjustable output voltage.

In one embodiment, the driving power control command further includes: a high voltage level period corresponding to the high voltage level; and/or a low voltage level period corresponding to the low voltage level; wherein the conversion controller circuit is further configured to operably determine the high voltage level period and/or the low voltage level period.

In one embodiment, the conversion controller circuit is configured to operably control the adjustable output voltage to be at the low voltage level according to the driving power control command, and after the adjustable output voltage has remained at the low voltage level for the low voltage level period, the conversion controller circuit is configured to operably control the adjustable output voltage to be at the high voltage level.

In one embodiment, the low voltage level is a zero voltage level; when the adjustable output voltage is at the high voltage level, the wireless communication module remains at an active operation mode; and when the adjustable output voltage is at the zero voltage level, the wireless communication module is cut off and cease active operation.

In one embodiment, there is a lower limit voltage level which is required for the wireless communication module to remain at an active operation mode; wherein the low voltage level is greater than or equal to the lower limit voltage level and the low voltage level is smaller than the high voltage level.

In one embodiment, the conversion controller circuit is configured to operably control the adjustable output voltage to periodically switch between the high voltage level and the low voltage level according to the driving power control command.

In one embodiment, the conversion controller circuit includes: a DC-DC converter circuit, which is coupled between the AC-DC converter circuit and the wireless communication module, the DC-DC converter circuit being configured to operably receive the input power and convert the input power to the adjustable output voltage which is supplied to the wireless communication module by the DC-DC converter circuit.

In one embodiment, the DC-DC converter circuit includes: a low dropout regulator (LDO) or a switching regulator.

In one embodiment, the communication interface includes: a single-wire communication interface, a double-wire communication interface or a multi-wire communication interface.

In one embodiment, the wireless communication means includes at least one of the following: electro-magnetic communication, radio frequency mobile communication, Wi-Fi, Bluetooth, IoT (Internet of Thing), LoRaWAN, ZigBee and/or infra-red wireless communication; wherein the wireless communication device includes one of the following: an electro-magnetic remote controller (RC), an RF RC, a mobile smartphone, an IoT RC, a Wi-Fi RC, a Wi-Fi router, a Bluetooth RC, a LoRaWAN RC, a ZigBee RC or an infra-red RC, which is corresponding to the wireless communication means.

In one embodiment, the power stage includes one of the following circuits: (1) a buck converter circuit; (2) a tapped-inductor buck converter circuit; (3) a buck-boost converter circuit; and/or (4) a flyback converter circuit.

From another perspective, the present invention provides a conversion controller circuit for use in a lighting system, wherein the lighting system comprises: a power supply circuit, which is coupled to the light emission device and which is configured to operably receive an input power and convert the input power to the output power; an AC-DC converter circuit, which is coupled to the power supply circuit and which is configured to operably receive an AC power and convert the AC power to the input power; and a wireless communication module, which is coupled to the power supply circuit via a communication interface and which is configured to operably receive an external command and generate an adjustment command according to the external command, and wherein the wireless communication module is configured to operably transmit the adjustment command to the power supply circuit via the communication interface; wherein the power supply circuit includes: a power stage including at least one power switch, wherein the power stage is configured to operably convert the input power to the output power; and the conversion controller circuit; the conversion controller circuit comprising: a DC-DC converter circuit, which is coupled between the AC-DC converter circuit and the wireless communication module, the DC-DC converter circuit being configured to operably receive the input power and convert the input power to a adjustable output voltage, wherein the adjustable output voltage is supplied to the wireless communication module to power the wireless communication module; wherein the conversion controller circuit is configured to operably generate a switching signal for controlling the at least one power switch to generate the output power; wherein the adjustment command includes a luminance adjustment command and a driving power control command; wherein the conversion controller circuit is configured to operably control the power stage according to the luminance adjustment command, to adjust an output current of the output power, thereby adjusting a luminance of the light emission device; wherein the DC-DC converter circuit is configured to operably control the adjustable output voltage according to the driving power control command, to regulate the adjustable output voltage to a high voltage level or a low voltage level; wherein a power consumption of the wireless communication module when operating under the low voltage level is smaller than a power consumption of the wireless communication module when operating under the high voltage level.

In one embodiment, the conversion controller circuit is configured to operably control the adjustable output voltage to be at the low voltage level according to the driving power control command, and wherein after the adjustable output voltage has remained at the low voltage level for the low voltage level period, the conversion controller circuit is configured to operably control the adjustable output voltage to be at the high voltage level.

In one embodiment, the DC-DC converter circuit includes: a low dropout regulator (LDO) or a switching regulator.

The objectives, technical details, features, and effects of the present invention will be better understood with regard to the detailed description of the embodiments below.

BRIEF DESCRIPTION OF THE DRAWINGS

FIG. 9A shows an embodiment of a DC-DC converter circuit of the conversion controller circuit of the present invention.

FIG. 9B shows another embodiment of the DC-DC converter circuit of the conversion controller circuit of the present invention.

DESCRIPTION OF THE PREFERABLE EMBODIMENTS

The drawings as referred to throughout the description of the present invention are for illustration only, to show the interrelations between the circuits and the signal waveforms, but not drawn according to actual scale of circuit sizes and signal amplitudes and frequencies.

Figure 1:
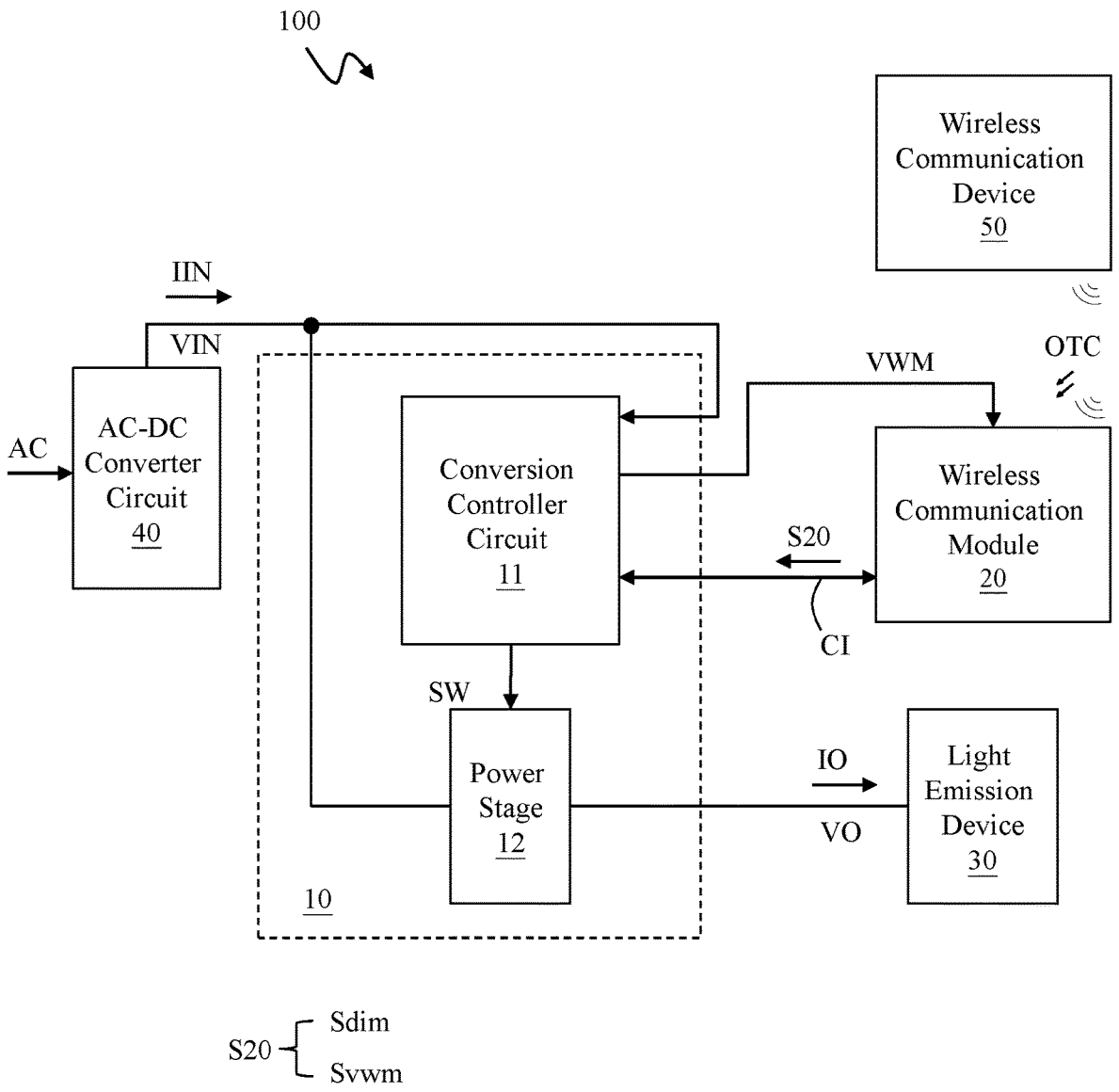
FIG. 1 shows a schematic block diagram of a lighting system according to an embodiment of the present invention.

Please refer to FIG. 1, which shows a schematic block diagram of a lighting system (i.e., the lighting system 100) according to an embodiment of the present invention.

The lighting system 100 of this embodiment is configured to operably supply an output power to an external light emission device 30. In this embodiment, the lighting system 100 comprises: a power supply circuit 10, an AC-DC converter circuit 40 and a wireless communication module 20.

As shown in FIG. 1, the power supply circuit 10 is coupled to the light emission device 30 and is configured to operably receive an input power. The power supply circuit 10 is configured to operably convert the received input power to the output power. In one embodiment, the power supply circuit 10 can include, for example but not limited to, a conversion controller circuit 11 and a power stage 12.

In one embodiment, the conversion controller circuit 11 is configured to operably obtain a power PIN of the input power according to an input voltage VIN and an input current IIN which are generated from the AC-DC converter circuit 40. In other words, under such circumstance, the power PIN of the input power is equal to a product of the input voltage VIN multiplied by the input current IIN. That is, the power PIN of the input power can be represented by the following equation: PIN=IIN*VIN.

In addition, in one embodiment, the power stage 12 is configured to operably convert the input power to the output power. Under such circumstance, a power PO of the output power can be obtained according to an output voltage VO and an output current IO which are generated from the power supply circuit 10. In other words, under such circumstance, the power PO of the output power is equal to a product of the output voltage VO multiplied by the output current IO. That is, the power PO of the output power can be represented by the following equation: PO=IO*VO.

Figure 3:
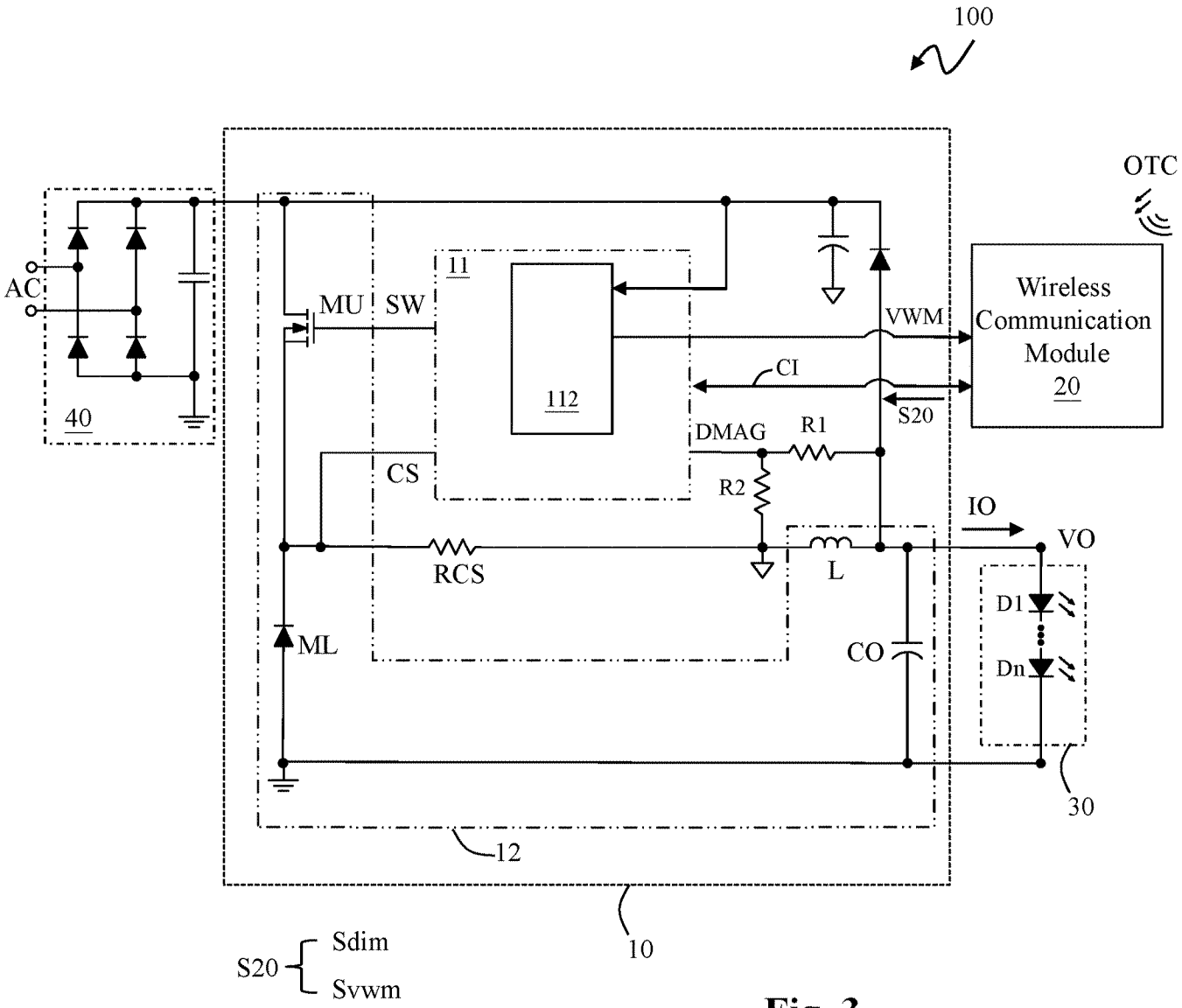
FIG. 3 shows an embodiment of a power stage of the present invention.

Please refer to FIG. 3 along with FIG. 1. FIG. 3 shows an embodiment of a power stage of the present invention.

As shown in FIG. 1, the AC-DC converter circuit 40 is coupled to the power supply circuit 10 and is configured to operably receive an alternating current (AC) power. The AC-DC converter circuit 40 is configured to operably convert the AC power to a direct current (DC) input power. As shown in FIG. 3, in one embodiment, the AC-DC converter circuit 40 can be, for example but not limited to, a rectifier device. It should be understood that the implementation of the AC-DC converter circuit 40 as the rectifier device in the above-mentioned preferred embodiment is only an illustrative example, but not for limiting the scope of the present invention.

Please still refer to FIG. 1. The wireless communication module 20 is coupled to the power supply circuit 10 via a communication interface CI. In this embodiment, the wireless communication module 20 is configured to operably receive an external command OTC from a wireless communication device 50 via a wireless communication means. Besides, in this embodiment, the wireless communication module 20 is configured to operably generate an adjustment command S20 according to the external command OTC. Moreover, in this embodiment, the wireless communication module is configured to operably transmit the adjustment command S20 to the power supply circuit 10 via the communication interface CI. In one embodiment, alternatively, the wireless communication module 20 is configured to operably generate an adjustment command S20 according to a power requirement of the wireless communication module 20.

As shown in FIG. 1, in one embodiment, the adjustment command S20 includes a luminance adjustment command Sdim and/or a driving power control command Svwm (the details of the luminance adjustment command Sdim and the driving power control command Svwm will be described later).

In one embodiment, the wireless communication module 20 can receive an external command OTC via wireless communication. In one embodiment, the wireless communication means adopted by the wireless communication module 20 can be, for example but not limited to, electromagnetic communication, radio frequency mobile communication, wireless internet (e.g., Wi-Fi, LoRaWAN, or ZigBee and so on), Bluetooth, IoT (Internet of Thing), near field communication (NFC), infra-red wireless communication and/or any other ways of wireless communication. In one embodiment, the wireless communication device includes one of the following: an electro-magnetic remote controller (RC), an RF RC, a mobile smartphone, an IoT RC, a Wi-Fi RC, a Wi-Fi router, a Bluetooth RC, a LoRaWAN RC, a ZigBee RC or an infra-red RC, which is corresponding to the wireless communication means.

Figure 10A:
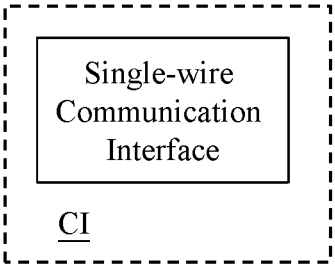
FIG. 10A shows an embodiment of a communication interface of the present invention.
Figure 10B:
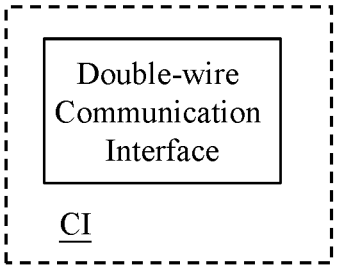
FIG. 10B shows another embodiment of the communication interface of the present invention.
Figure 10C:
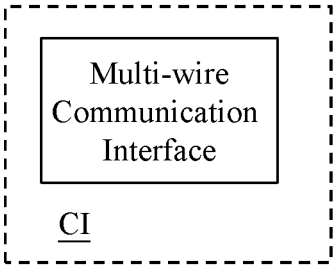
FIG. 10C shows yet another embodiment of the communication interface of the present invention.

Please refer to FIGS. 10A-10C along with FIG. 1. FIG. 10A shows an embodiment of a communication interface of the present invention. FIG. 10B shows another embodiment of the communication interface of the present invention. FIG. 10C shows yet another embodiment of the communication interface of the present invention.

As shown in FIG. 10A, in one embodiment, the communication interface CI can be, for example but not limited to, a single-wire communication interface. As shown in FIG. 10B, in another embodiment, the communication interface CI can be, for example but not limited to, a double-wire communication interface. As shown in FIG. 10C, in yet another embodiment, the communication interface CI can be, for example but not limited to, a multi-wire communication interface.

Figure 11A:
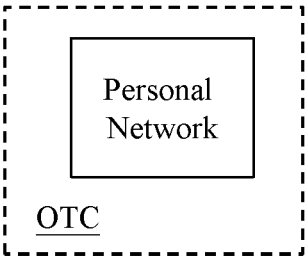
FIG. 11A shows an embodiment of an external command of the present invention.
Figure 11B:
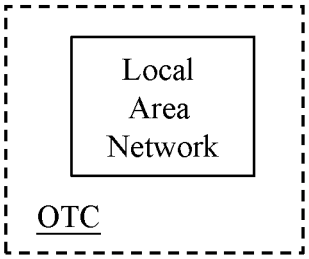
FIG. 11B shows another embodiment of the external command of the present invention.
Figure 11C:
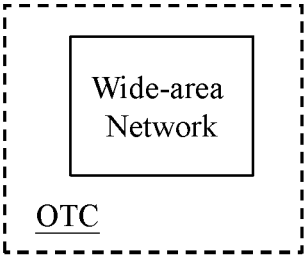
FIG. 11C shows yet another embodiment of the external command of the present invention.

Please refer to FIGS. 11A-11C along with FIG. 1. FIG. 11A shows an embodiment of a source of an external command of the present invention. FIG. 11B shows a source of another embodiment of the external command of the present invention. FIG. 11C shows yet another embodiment of a source of the external command of the present invention.

As shown in FIG. 11A, in one embodiment, the external command OTC can come from, for example but not limited to, a wireless personal network. As shown in FIG. 11B, in another embodiment, the external command OTC can come from, for example but not limited to, a wireless local area network (WLAN). As shown in FIG. 11C, in yet another embodiment, the external command OTC can come from, for example but not limited to, a wireless wide-area network (WAN).

In one specific embodiment, regardless whether the external command OTC comes from a source shown in FIG. 11A, FIG. 11B or FIG. 11C, in the present invention, the device generating the external command OTC can be, for example but not limited to, a smart cell phone, a cell phone, a cellular mobile telephone, a laptop computer, a notebook computer, a tablet computer, a desktop computer, a personal digital assistant (PDA), a monitor, a set top box, a home entertainment (HE) device, the various aforementioned remote controllers and/or any other electronic devices which are capable of performing data communication via wireless communication network.

Please refer to FIG. 3 in conjugation with FIG. 1. In one embodiment, as shown in FIG. 3, the power stage 12 includes at least one power switch MU. The power stage 12 is configured to operably convert the input power to the output power. As shown in FIG. 3, in one embodiment, the power stage 12 can be, for example but not limited to, a buck converter circuit. The buck converter circuit can include, for example but not limited to, the power switch MU (which functions as an upper-gate switch), a diode ML (which functions as a lower-gate power device), an inductor L and a capacitor CO. The buck converter circuit shown in FIG. 3 is an asynchronous buck converter circuit. It should be understood that the implementation of the power stage 12 as the asynchronous buck converter circuit in the above-mentioned preferred embodiment is only an illustrative example, but not for limiting the scope of the present invention. Certainly, in other embodiments, it is also practicable and within the scope of the present invention that the power stage 12 can be a synchronous buck converter circuit, by replacing the diode ML with another power switch. In addition, the power stage 12 is not limited to be a buck converter circuit, but can be any other types of power stage (examples of other types of power stage will be described later). Note that the wireless communication device 50 is not shown in FIG. 3 for simplicity, but can be considered as the same as the previous embodiments.

Please still refer to FIG. 3 in conjugation with FIG. 1. In this embodiment, the conversion controller circuit 11 is configured to operably receive the input power and convert the input power to a adjustable output voltage VWM. The adjustable output voltage VWM is supplied to the wireless communication module 20 to power the wireless communication module 20. Besides, the conversion controller circuit 11 is configured to operably generate a switching signal SW for controlling the power switch MU to generate the output power.

In one embodiment, the light emission device 30 can include, for example but not limited to, light emitting diodes (LED) D1~Dn which are connected to one another in series (as shown in FIG. 3). In other embodiment, it is also practicable and within the scope of the present invention that the light emission device 30 can include an array consisting of a group of LEDs or a circuit consisting of any other light emission semiconductor devices.

Figure 4:
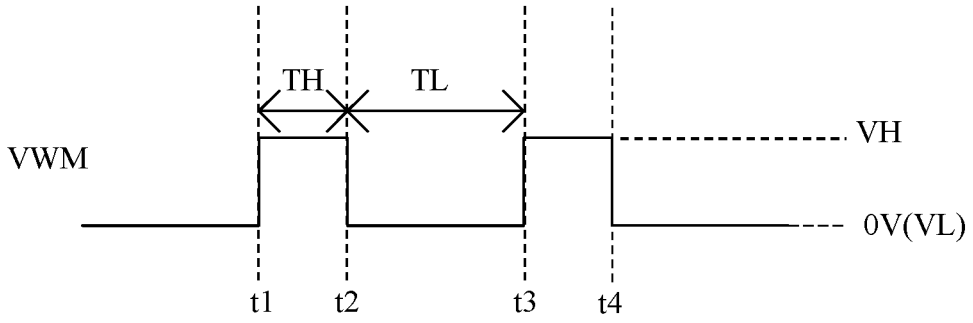
FIG. 4 shows an embodiment of a waveform of a adjustable output voltage.

Please refer to FIG. 4 in conjugation with FIG. 1 and FIG. 3. FIG. 4 shows an embodiment of a waveform of a adjustable output voltage.

One feature by which the present invention is advantageous over the prior art is that: the lighting system 100 of the present invention is capable of adjusting, respectively, the luminance of the light emission device 30 and the power (i.e., the adjustable output voltage VWM) required for the wireless communication module 20.

In more detail, on one hand, that "the lighting system 100 of the present invention is capable of adjusting the luminance of the light emission device 30", refers to that: the conversion controller circuit 11 of the lighting system 100 of the present invention can control the power stage 12 according to the luminance adjustment command Sdim, to adjust an output current IO of the output power, thereby adjusting a luminance of the light emission device 30. In one embodiment, the conversion controller circuit 11 of the lighting system 100 of the present invention can control the power stage 12 according to the luminance adjustment command Sdim to turn ON or turn OFF the light emission device 30.

On the other hand, that "the lighting system 100 of the present invention is capable of adjusting the power (i.e., the adjustable output voltage VWM) required for the wireless communication module 20", refers to that: the conversion controller circuit 11 of the lighting system 100 of the present invention can control the adjustable output voltage VWM according to the driving power control command Svwm, to regulate the adjustable output voltage VWM to a high voltage level VH or a low voltage level VL (as shown by VH and VL in FIG. 4). After the luminance of the light emission device 30 has been adjusted, usually a user will maintain such luminance for a period of time, so it is not necessary for the wireless communication module 20 to keep transmitting the luminance adjustment command Sdim to the conversion controller circuit 11. In other words, it is not necessary for the wireless communication module 20 to remain at an active operation mode. In fact, according to the present invention, after the luminance of the light emission device 30 has been adjusted, the wireless communication module 20 can enter into a sleep mode and cease active operation.

According to the present invention, a power consumption of the wireless communication module 20 when operating under the low voltage level VL is smaller than a power consumption of the wireless communication module 20 when operating under the high voltage level VH (i.e., operating under the active operation mode). Thus, the lighting system 100 of the present invention is capable of reducing power consumption through adjusting the power provided to the wireless communication module 20 (i.e., through adjusting the adjustable output voltage VWM). (The features and details as to how the lighting system 100 of the present invention respectively adjust the luminance of the light emission device 30 and the power required for the wireless communication module 20 will be described later).

Figure 2:
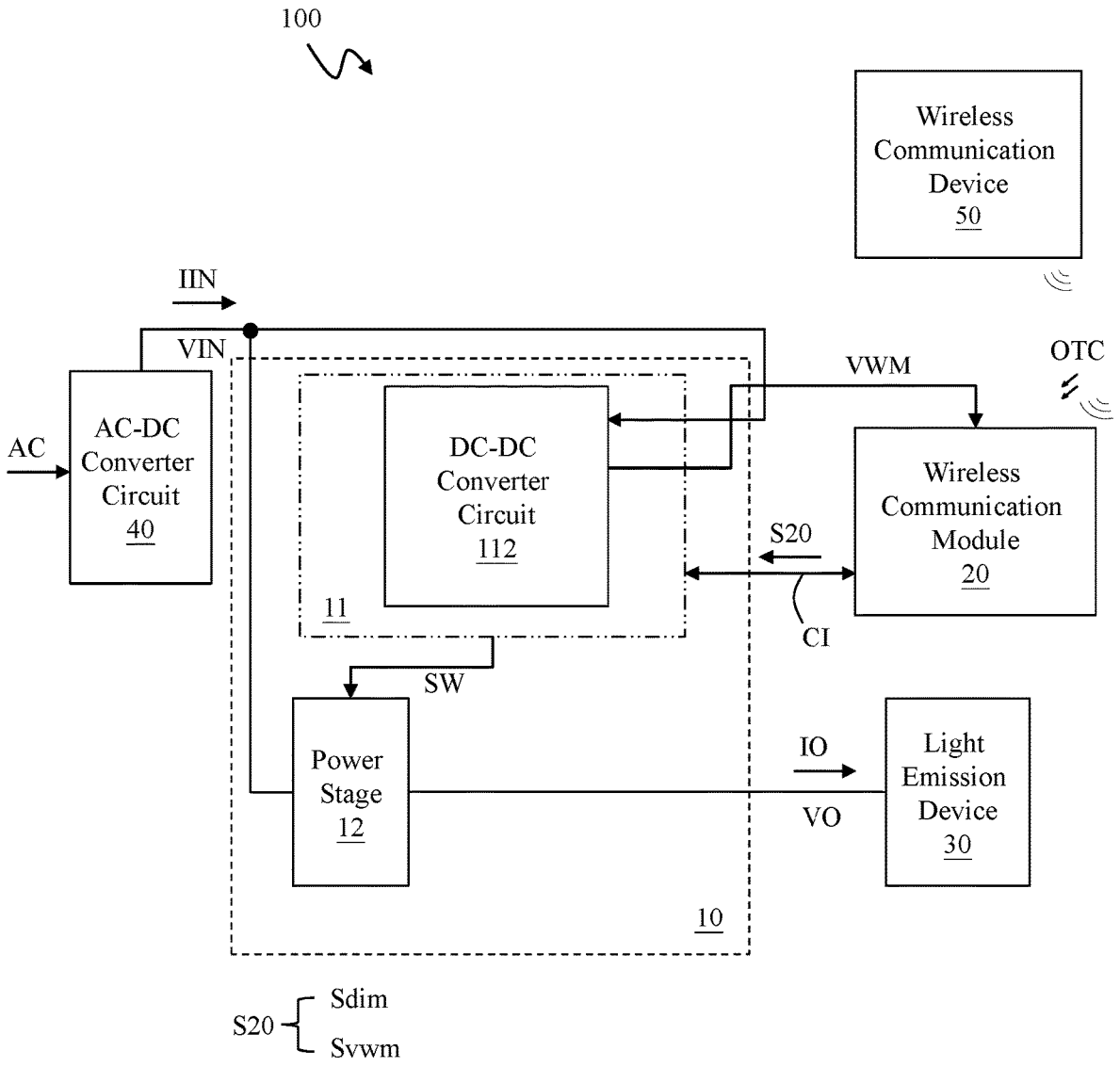
FIG. 2 shows a specific embodiment of a conversion controller circuit of the present invention.

Please refer to FIG. 2 in conjugation with FIG. 1 and FIG. 3. FIG. 2 shows a specific embodiment of a conversion controller circuit (i.e., the conversion controller circuit 11) of the present invention. As shown in FIG. 2, in one embodiment, the conversion controller circuit 11 includes a DC-DC converter circuit 112. The DC-DC converter circuit 112 is coupled between the AC-DC converter circuit 40 and the wireless communication module 20. The DC-DC converter circuit 112 is configured to operably receive the input power and convert the input power to the adjustable output voltage VWM. The adjustable output voltage VWM is supplied to the wireless communication module 20 by the DC-DC converter circuit 112.

Please refer to FIGS. 9A-9B along with FIG. 2. FIG. 9A shows an embodiment of a DC-DC converter circuit of the conversion controller circuit of the present invention. FIG. 9B shows another embodiment of the DC-DC converter circuit of the conversion controller circuit of the present invention.

As shown in FIG. 9A, in one embodiment, the DC-DC converter circuit 112 can be, for example but not limited to, a low dropout regulator (LDO). As shown in FIG. 9B, in another embodiment, the DC-DC converter circuit 112 can be, for example but not limited to, a switching regulator.

Figure 5:
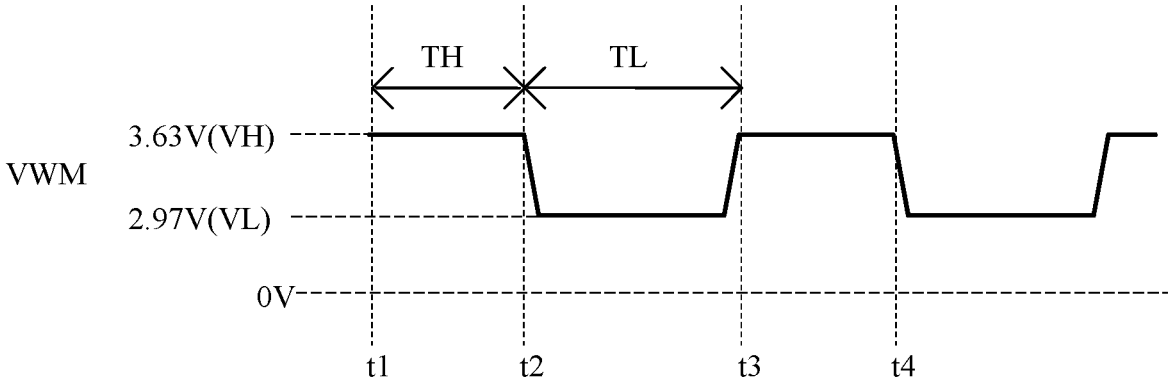
FIG. 5 shows another embodiment of the waveform of the adjustable output voltage.

Please refer to FIGS. 4-5 along with FIG. 3. As described above, the conversion controller circuit 11 of the lighting system 100 of the present invention can control the adjustable output voltage VWM according to the driving power control command Svwm, to regulate the adjustable output voltage VWM to the high voltage level VH or the low voltage level VL. FIG. 4 shows an example of the high voltage level VH and the low voltage level VL in the waveform of the adjustable output voltage VWM. FIG. 5 shows another example of the high voltage level VH and the low voltage level VL in the waveform of the adjustable output voltage VWM.

In one embodiment, the driving power control command Svwm includes: voltage level information which is related to the adjustable output voltage VWM. Such voltage level information can be, for example but not limited to, the high voltage level VH and the low voltage level VL shown in FIG. 4 or FIG. 5.

In another embodiment, in addition to the voltage level information which is related to the adjustable output voltage VWM, the driving power control command Svwm further includes: a high voltage level period TH (e.g., as shown by a period ranging from a timing point t1 to a timing point t2 in FIG. 4 and FIG. 5) corresponding to the high voltage level VH and/or a low voltage level period TL (e.g., as shown by a period ranging from the timing point t2 to a timing point t3 in FIG. 4 and FIG. 5) corresponding to the low voltage level VL. In one embodiment, the conversion controller circuit 11 is further configured to operably determine the high voltage level period TH and/or the low voltage level period TL.

Please still refer to FIG. 4 along with FIG. 3. As shown in FIG. 4, in one embodiment, the low voltage level VL can be, for example but not limited to, a zero voltage level. The zero voltage level is substantially equal to 0V, as shown in FIG. 4. As described above, because the adjustable output voltage VWM provides the power required for the wireless communication module 20 to be in active operation, in this embodiment, when the adjustable output voltage VWM remains at the high voltage level VH (e.g., as shown by VH in FIG. 4), the wireless communication module 20 will remain at the active operation mode. In contrast, when the adjustable output voltage VWM is at the zero voltage level (e.g., as shown by 0V in FIG. 4), the wireless communication module 20 will enter into the sleep mode and cease active operation. In one embodiment, when the adjustable output voltage VWM is at the zero voltage level, the wireless communication module 20 is cut off and cease active operation.

According to the present invention, the power consumption of the wireless communication module 20 when operating under the zero voltage level (i.e., operating under the sleep mode) is smaller than the power consumption of the wireless communication module 20 when operating under the high voltage level VH (i.e., operating under the active operation mode). Consequently and desirably, the lighting system 100 of the present invention is capable of greatly reducing power consumption through adjusting the power provided to the wireless communication module 20 (i.e., through adjusting the adjustable output voltage VWM).

Note that, in one embodiment, the high voltage level VH of the adjustable output voltage VWM can correspond to a normal operation of the wireless communication module 20, wherein the wireless communication module 20 can perform wireless communication normally. In one embodiment, the low voltage level VL of the adjustable output voltage VWM can correspond to a standby mode, a low power mode, a sleep mode or the similar, wherein in these modes, the wireless communication module 20 can perform only limited functions so that the power consumption of the wireless communication module 20 can be lower with the low voltage level VL.

The conversion controller circuit 11 is configured to operably control the adjustable output voltage VWM to be at the low voltage level (e.g., the zero voltage level such as 0V in FIG. 4) according to the driving power control command Svwm. And, after the adjustable output voltage VWM has remained at the low voltage level for the low voltage level period TL (e.g., as shown by the period ranging from the timing point t2 to the timing point t3 in FIG. 4), the conversion controller circuit 11 is configured to operably control the adjustable output voltage VWM to be at the high voltage level VH.

In other words, in the embodiment shown in FIG. 4, the lighting system 100 of the present invention can, according to the driving power control command Svwm, control the adjustable output voltage VWM to be at the zero voltage level (e.g., as shown by 0V in FIG. 4), whereby the wireless communication module 20 enters into the sleep mode and to cease active operation, thereby saving power. And, after the wireless communication module 20 has entered into the sleep mode and has ceased active operation for the low voltage level period TL (e.g., as shown by the period ranging from the timing point t2 to the timing point t3 in FIG. 4), the lighting system 100 of the present invention can, according to the driving power control command Svwm, control the adjustable output voltage VWM to be at the high voltage level VH, thereby waking up the wireless communication module 20 to resume to the active operation mode (e.g., as shown by the timing point t3 in FIG. 4, which is the timing point when the wireless communication module 20 resumes from the sleep mode to the active operation mode).

Please still refer to FIG. 5 along with FIG. 3. As shown in FIG. 5, in one embodiment, the wireless communication module 20 has a lower limit voltage level, which is required for the wireless communication module 20 to remain at the active operation mode. The low voltage level VL can be, for example but not limited to, greater than or equal to the lower limit voltage level. And, the low voltage level VL is smaller than the high voltage level VH. In one embodiment, the wireless communication module 20 of the lighting system 100 for example can be the Model No. "LinkIt 9697". According to the specification of the wireless communication module under Model No. "LinkIt 9697", the high voltage level VH is 3.63V, whereas, the lower limit voltage level is 2.67V, as shown in FIG. 5. In this embodiment, preferably, the low voltage level VL is equal to the lower limit voltage level, i.e. 2.67V, as shown in FIG. 5.

As described above, because the adjustable output voltage VWM is adopted to power the wireless communication module 20 when the wireless communication module 20 is in active operation, in this embodiment, when the adjustable output voltage VWM remains at the high voltage level VH (e.g., 3.63V in FIG. 5), the wireless communication module 20 will remain at a first active operation mode. And, when the adjustable output voltage VWM remains at the lower limit voltage level (which for example is equal to the low voltage level VL, i.e. 2.67V in FIG. 5), the wireless communication module 20 will still remain at a second active operation mode.

As shown in FIG. 5, according to the present invention, the power consumption of the wireless communication module 20 when operating under the lower limit voltage level (i.e., operating under the second active operation mode) is smaller than the power consumption of the wireless communication module 20 when operating under the high voltage level VH (i.e., operating under the first active operation mode). Consequently and desirably, the lighting system 100 of the present invention is capable of reducing power consumption through adjusting the power provided to the wireless communication module 20 (i.e., through adjusting the adjustable output voltage VWM).

After the conversion controller circuit 11 controls the adjustable output voltage VWM to be at the lower limit voltage level (which for example is equal to the low voltage level VL, i.e. 2.67V in FIG. 5) according to the driving power control command Svwm for the low voltage level period IL (e.g., as shown by the period ranging from the timing point t2 to the timing point t3 in FIG. 5), the conversion controller circuit 11 is configured to operably control the adjustable output voltage VWM to be at the high voltage level VH (e.g., 3.63V in FIG. 5).

In other words, in the embodiment shown in FIG. 5, the lighting system 100 of the present invention can, according to the driving power control command Svwm, control the adjustable output voltage VWM to remain at the lower limit voltage level (e.g., 2.67V in FIG. 5), so that the wireless communication module 20 remains at an operation mode in which the power consumption is relatively small. And, after the adjustable output voltage VWM has remained at the operation mode in which the power consumption is relatively small for the low voltage level period TL (e.g., as shown by the period ranging from the timing point t2 to the timing point t3 in FIG. 5), the conversion controller circuit 11 of the lighting system 100 of the present invention can, according to the driving power control command Svwm, control the adjustable output voltage VWM to be at the high voltage level VH, thereby causing the wireless communication module 20 to resume to an operation mode in which the power consumption is relatively great (e.g., as shown by the timing point t3 in FIG. 5, which is the timing point where the wireless communication module 20 resumes from the second active operation mode where the power consumption is relatively small to the first active operation mode where the power consumption is relatively great).

It should be understood that the above-mentioned "Model No. LinkIt 9697", "3.63V" and "2.67V" in the above-mentioned preferred embodiment are only an illustrative example, but not for limiting the scope of the present invention. In other embodiments, other Model types and voltage numbers are also practicable and within the scope of the present invention.

Regardless whether the conversion controller circuit 11 is implemented as the embodiment shown in FIG. 4 or the embodiment shown in FIG. 5, in one embodiment, the conversion controller circuit 11 is configured to operably control the adjustable output voltage VWM to periodically switch between the high voltage level VH and the low voltage level VL according to the driving power control command Svwm.

"To periodically switch between the high voltage level VH and the low voltage level VL", refers to that: for example the lighting system 100 of the present invention can, according to the driving power control command Svwm, control the adjustable output voltage VWM to be at the high voltage level VH for the high voltage level period TH (e.g., as shown by the period ranging from the timing point t1 to the timing point t2 in FIG. 4 and FIG. 5); after the timing point t2, the lighting system 100 of the present invention subsequently can, according to the driving power control command Svwm, control the adjustable output voltage VWM to be at the low voltage level VL for the low voltage level period IL (e.g., as shown by the period ranging from the timing point t2 to the timing point t3 in FIG. 4 and FIG. 5); after the timing point t3, the lighting system 100 of the present invention subsequently can, according to the driving power control command Svwm, control the adjustable output voltage VWM to resume to be at the high voltage level VH for the high voltage level period TH (e.g., as shown by the period ranging from the timing point t3 to the timing point t4 in FIG. 4 and FIG. 5).

As mentioned earlier, in one embodiment, the adjustment command S20 can be generated according to a power requirement of the wireless communication module 20. For example, the wireless communication module 20 can be configured to include at least two states of power requirement, one for higher power requirement (corresponding to for example the high voltage level VH as in the previous embodiment), one for low power requirement (corresponding to for example the low voltage level VL as in the previous embodiment). In this embodiment, the configuration can be pre-programmed, instead of being configured by the wireless communication device 50.

Figure 6:
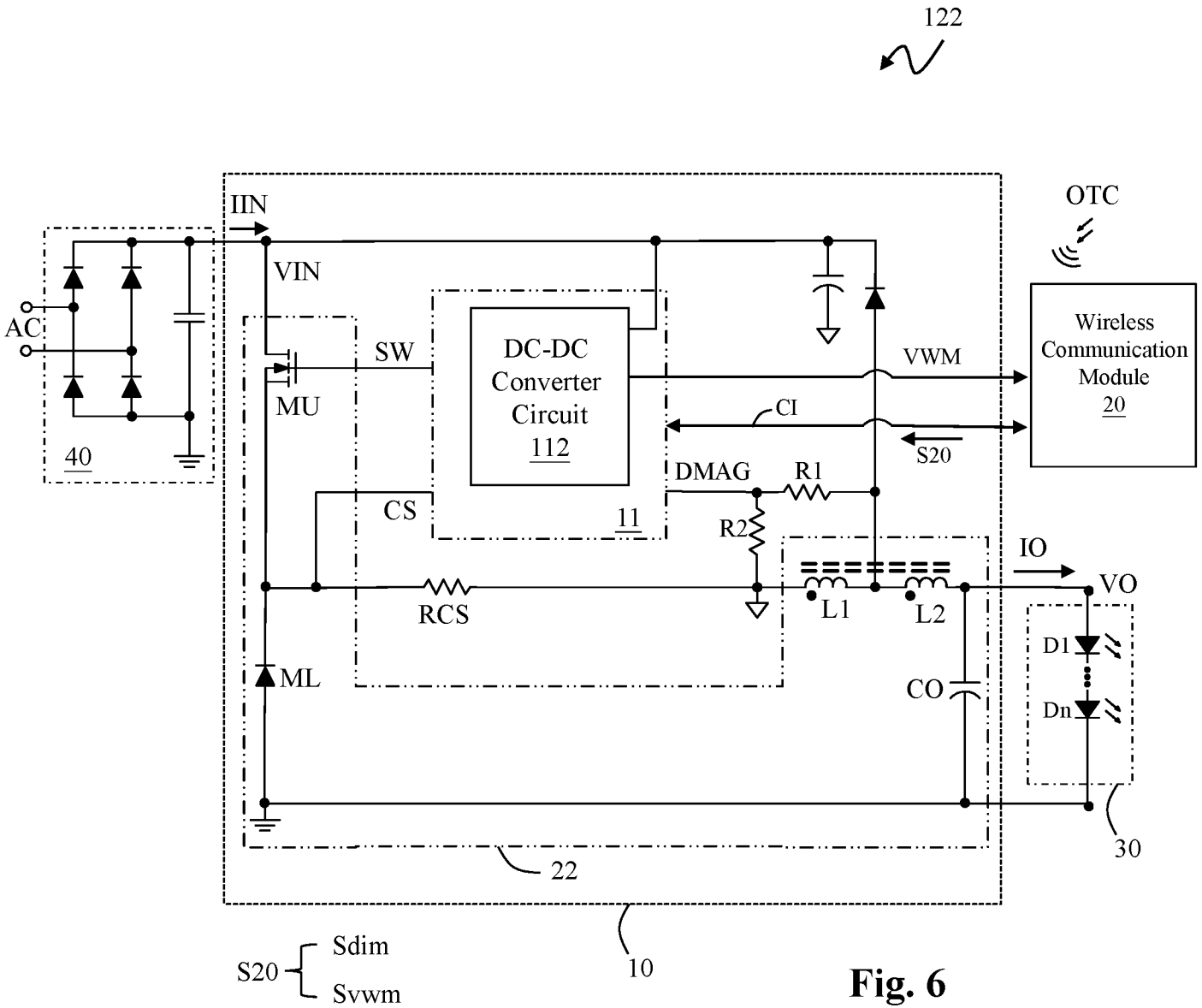
FIG. 6 shows another embodiment of the power stage of the present invention.

Please refer to FIG. 6 along with FIG. 3. FIG. 6 shows another embodiment of the power stage (i.e., the power stage 22) of the lighting system (i.e., the lighting system 122) of the present invention.

The lighting system 122 in the embodiment shown in FIG. 6 is similar to the lighting system 100 in the embodiment shown in FIG. 3, but is different in that: the power stage 22 of the lighting system 122 in the embodiment shown in FIG. 6 is a tapped-inductor buck converter circuit, whereas, the power stage 12 of the lighting system 100 in the embodiment shown in FIG. 3 is a buck converter circuit. The tapped-inductor buck converter circuit in the embodiment shown in FIG. 6 is similar to the buck converter circuit in the embodiment shown in FIG. 3, but is different in that: the tapped-inductor buck converter circuit in the embodiment shown in FIG. 6 has two inductors L1 and L2, whereas, the buck converter circuit in the embodiment shown in FIG. 3 has one single inductor L. The tapped-inductor buck converter circuit and the buck converter circuit are well known to those skilled in the art, so the details thereof are not redundantly explained here.

Figure 7:
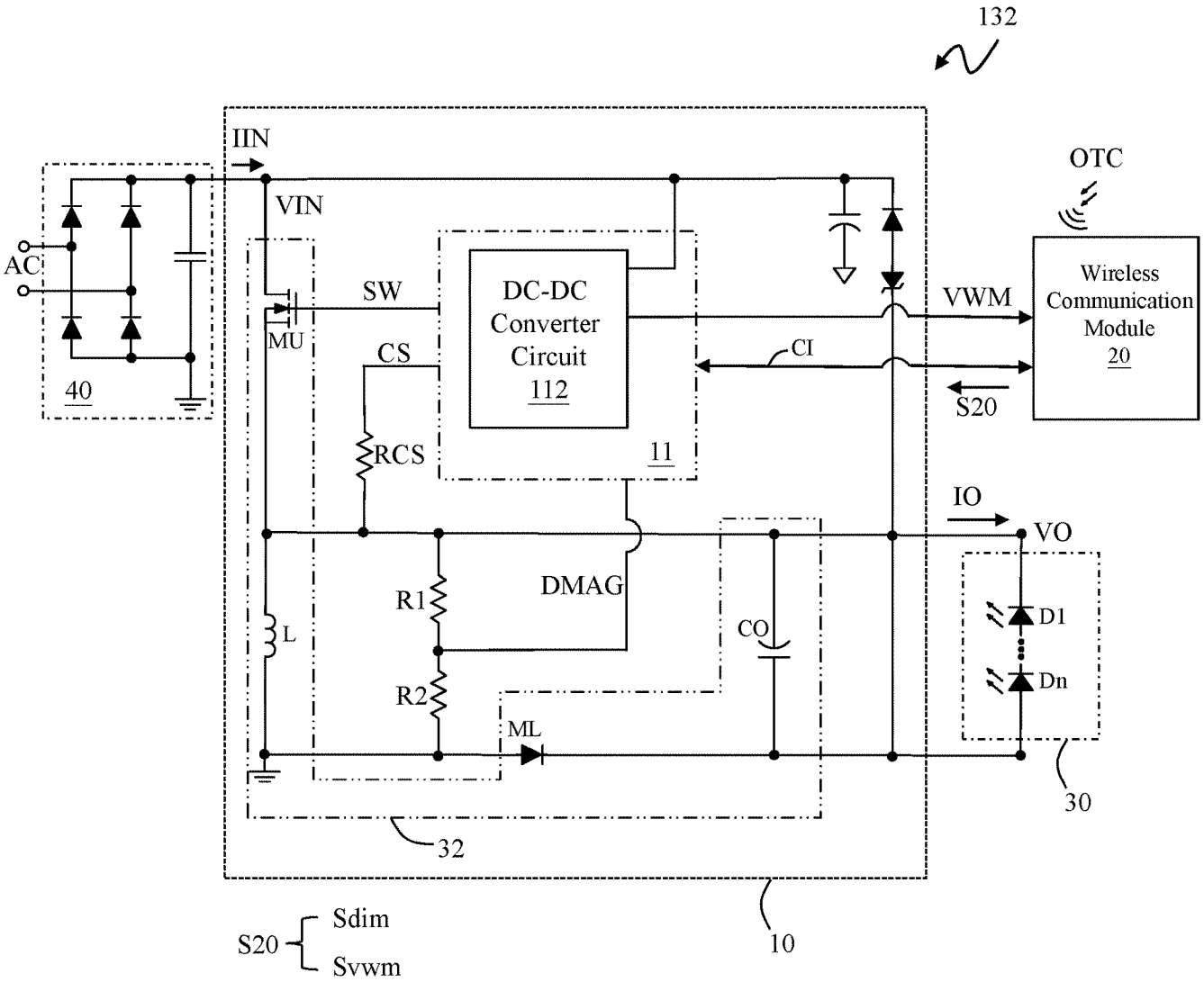
FIG. 7 shows yet another embodiment of the power stage of the present invention.

Please refer to FIG. 7 along with FIG. 3. FIG. 7 shows yet another embodiment of the power stage (i.e., the power stage 32) of the lighting system (i.e., the lighting system 132) of the present invention.

The lighting system 132 in the embodiment shown in FIG. 7 is similar to the lighting system 100 in the embodiment shown in FIG. 3, but is different in that: the power stage 32 of the lighting system 132 in the embodiment shown in FIG. 7 is a buck-boost converter circuit, whereas, the power stage 12 of the lighting system 100 in the embodiment shown in FIG. 3 is a buck converter circuit. The buck-boost converter circuit is well known to those skilled in the art, so the details thereof are not redundantly explained here.

Figure 8:
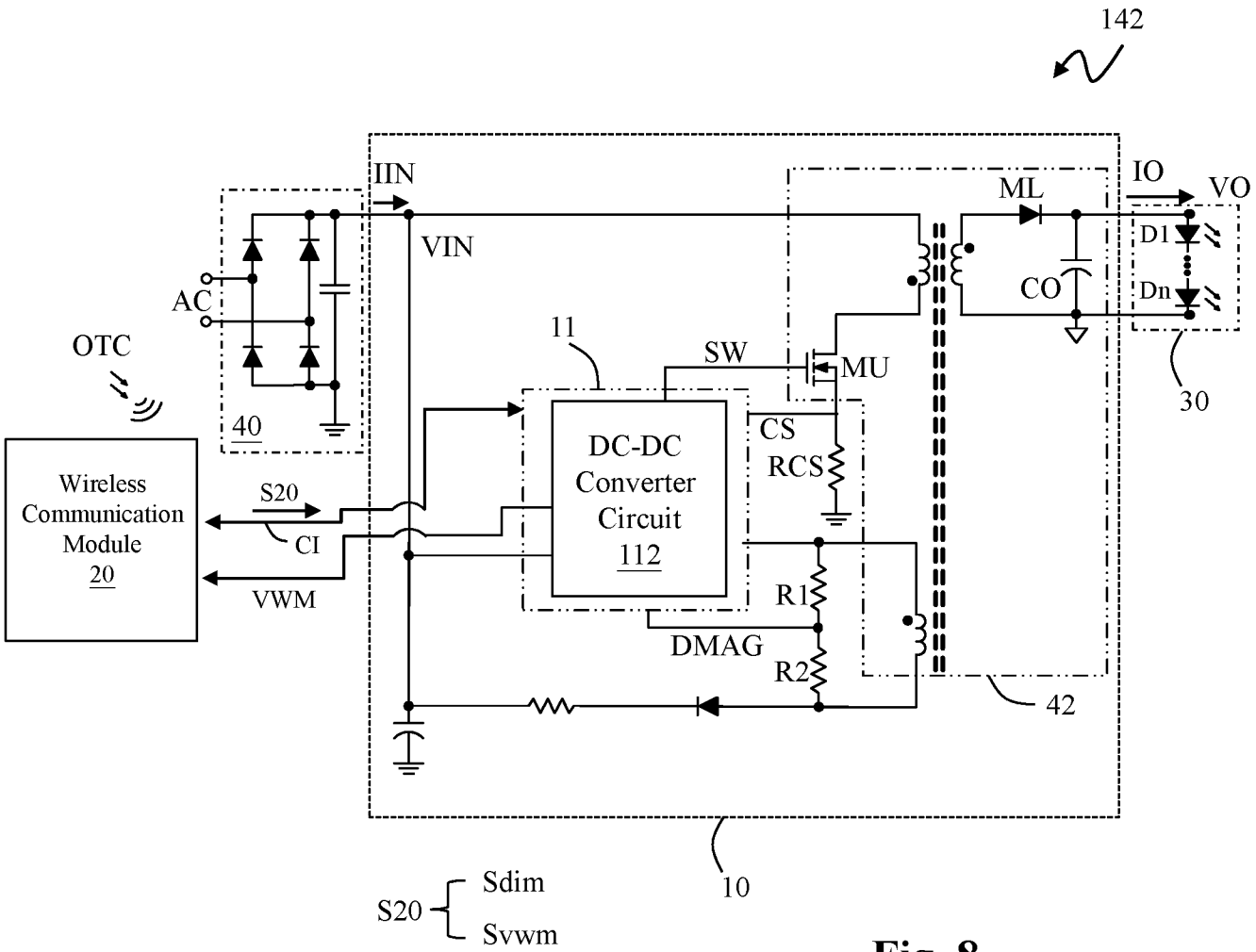
FIG. 8 shows still another embodiment of the power stage of the present invention.

Please refer to FIG. 8 along with FIG. 3. FIG. 8 shows still another embodiment of the power stage (i.e., the power stage 42) of the lighting system (i.e., the lighting system 142) of the present invention.

The lighting system 142 in the embodiment shown in FIG. 8 is similar to the lighting system 100 in the embodiment shown in FIG. 3, but is different in that: the power stage 42 of the lighting system 142 in the embodiment shown in FIG. 8 is a flyback converter circuit, whereas, the power stage 12 of the lighting system 100 in the embodiment shown in FIG. 3 is a buck converter circuit. The flyback converter circuit is well known to those skilled in the art, so the details thereof are not redundantly explained here.

The present invention has been described in considerable detail with reference to certain preferred embodiments thereof. It should be understood that the description is for illustrative purpose, not for limiting the scope of the present invention. An embodiment or a claim of the present invention does not need to achieve all the objectives or advantages of the present invention. The title and abstract are provided for assisting searches but not for limiting the scope of the present invention. Those skilled in this art can readily conceive variations and modifications within the spirit of the present invention. For example, to perform an action "according to" a certain signal as described in the context of the present invention is not limited to performing an action strictly according to the signal itself, but can be performing an action according to a converted form or a scaled-up or down form of the signal, i.e., the signal can be processed by a voltage-to-current conversion, a current-to-voltage conversion, and/or a ratio conversion, etc. before an action is performed. It is not limited for each of the embodiments described herein before to be used alone; under the spirit of the present invention, two or more of the embodiments described hereinbefore can be used in combination. For example, two or more of the embodiments can be used together, or, a part of one embodiment can be used to replace a corresponding part of another embodiment. In view of the foregoing, the spirit of the present invention should cover all such and other modifications and variations, which should be interpreted to fall within the scope of the following claims and their equivalents.

What is claimed is:

1. A lighting system, which is configured to operably supply an output power to a light emission device, the lighting system comprising:

a power supply circuit, which is coupled to the light emission device and which is configured to operably receive an input power and operably convert the input power to the output power;

an AC-DC converter circuit, which is coupled to the power supply circuit and which is configured to operably receive an AC power and operably convert the AC power to the input power; and a wireless communication module, which is coupled to the power supply circuit via a communication interface and which is configured to operably receive an external command from a wireless communication device via a wireless communication means, wherein the wireless communication module is configured to operably generate an adjustment command according to the external command or according to a power requirement of the wireless communication module, and wherein the wireless communication module is configured to operably transmit the adjustment command to the power supply circuit via the communication interface;

wherein the adjustment command includes a luminance control command and a driving power control command;

wherein the power supply circuit includes:

a power stage including at least one power switch, wherein the power stage is configured to operably convert the input power to the output power; and a conversion controller circuit, which is configured to operably generate a switching signal for controlling the at least one power switch of the power stage according to the luminance control command, to adjust an output current of the output power, thereby adjusting a luminance of the light emission device and/or controlling the light emission device to be ON/OFF;

wherein the conversion controller circuit includes a DC-DC converter circuit, which is coupled between the AC-DC converter circuit and the wireless communication module, the DC-DC converter circuit being configured to operably receive the input power and convert the input power to an adjustable output voltage which provides a supply power for powering the wireless communication module to operate;

wherein the conversion controller circuit is configured to operably control the adjustable output voltage according to the driving power control command, to regulate the adjustable output voltage to a high voltage level or a low voltage level;

wherein a power consumption of the wireless communication module when powered under the low voltage level is smaller than a power consumption of the wireless communication module when powered under the high voltage level.

2. The lighting system of claim 1, wherein the driving power control command includes: voltage level information which is related to the adjustable output voltage.

3. The lighting system of claim 2, wherein the driving power control command further includes:

a high voltage level period corresponding to the high voltage level; and/or a low voltage level period corresponding to the low voltage level;

wherein the conversion controller circuit is further configured to operably determine the high voltage level period and/or the low voltage level period.

4. The lighting system of claim 3, wherein the conversion controller circuit is configured to operably control the adjustable output voltage to be at the low voltage level according to the driving power control command, and wherein after the adjustable output voltage has remained at the low voltage level for the low voltage level period, the conversion controller circuit is configured to operably control the adjustable output voltage to be at the high voltage level.

5. The lighting system of claim 4, wherein:

the low voltage level is a zero voltage level;

when the adjustable output voltage is at the high voltage level, the wireless communication module remains at an active operation mode; and when the adjustable output voltage is at the zero voltage level, the wireless communication module is cut off and cease active operation.

6. The lighting system of claim 3, wherein the conversion controller circuit is configured to operably control the adjustable output voltage to periodically switch between the high voltage level and the low voltage level according to the driving power control command.

7. The lighting system of claim 1, wherein a lower limit voltage level is required for powering the wireless communication module to remain at an active operation mode; wherein the low voltage level is greater than or equal to the lower limit voltage level and the low voltage level is smaller than the high voltage level.

8. The lighting system of claim 1, wherein the conversion controller circuit includes:

a DC-DC converter circuit, which is coupled between the AC-DC converter circuit and the wireless communication module, the DC-DC converter circuit being configured to operably receive the input power and convert the input power to the adjustable output voltage which is supplied to the wireless communication module by the DC-DC converter circuit.

9. The lighting system of claim 8, wherein the DC-DC converter circuit includes: a low dropout regulator (LDO) or a switching regulator.

10. The lighting system of claim 1, wherein the communication interface includes: a single-wire communication interface, a double-wire communication interface or a multi-wire communication interface.

11. The lighting system of claim 1, wherein the wireless communication means includes at least one of the following: electro-magnetic communication, radio frequency mobile communication, Wi-Fi, Bluetooth, IoT (Internet of Thing), LoRaWAN, ZigBee or infra-red wireless communication;

wherein the wireless communication device includes one of the following: an electro-magnetic remote controller (RC), an RF RC, a mobile smartphone, an IoT RC, a Wi-Fi RC, a Wi-Fi router, a Bluetooth RC, a LoRaWAN RC, a ZigBee RC or an infra-red RC, which is corresponding to the wireless communication means.

12. The lighting system of claim 1, wherein the power stage includes one of the following circuits:

(1) a buck converter circuit;

(2) a tapped-inductor buck converter circuit;

(3) a buck-boost converter circuit; or (4) a flyback converter circuit.

13. A conversion controller circuit for use in a lighting system for supplying an output power to a light emission device, wherein the lighting system includes: an AC-DC converter circuit, which is coupled to the conversion controller circuit and which is configured to operably receive an AC power and convert the AC power to the input power, and a wireless communication module, which is coupled to the conversion controller circuit via a communication interface and which is configured to operably receive an external command and generate an adjustment command according to the external command, and wherein the wireless communication module is configured to operably transmit the adjustment command to the conversion controller circuit via the communication interface, wherein the conversion controller circuit is coupled to the light emission device and is configured to operably convert an input power to the output power, wherein the adjustment command includes a luminance control command and a driving power control command, wherein the conversion controller circuit comprises:

a power stage including at least one power switch, wherein the power stage is configured to operably convert the input power to the output power; and a DC-DC converter circuit, which is coupled between the AC-DC converter circuit and the wireless communication module, the DC-DC converter circuit being configured to operably receive the input power and convert the input power to an adjustable output voltage, which provides a supply power for powering the wireless communication module to operate;

wherein the conversion controller circuit is configured to operably generate a switching signal for controlling the at least one power switch of the power stage according to the luminance control command, to adjust an output current of the output power, thereby adjusting a luminance of the light emission device;

wherein the DC-DC converter circuit is configured to operably control the adjustable output voltage according to the driving power control command, to regulate the adjustable output voltage to a high voltage level or a low voltage level;

wherein a power consumption of the wireless communication module when powered under the low voltage level is smaller than a power consumption of the wireless communication module when powered under the high voltage level.

14. The conversion controller circuit of claim 13, wherein the driving power control command includes: voltage level information which is related to the adjustable output voltage.

15. The conversion controller circuit of claim 14, wherein the driving power control command further includes:

a high voltage level period corresponding to the high voltage level; and/or a low voltage level period corresponding to the low voltage level;

wherein the conversion controller circuit is further configured to operably determine the high voltage level period and/or the low voltage level period.

16. The conversion controller circuit of claim 15, wherein the conversion controller circuit is configured to operably control the adjustable output voltage to be at the low voltage level according to the driving power control command, and wherein after the adjustable output voltage has remained at the low voltage level for the low voltage level period, the conversion controller circuit is configured to operably control the adjustable output voltage to be at the high voltage level.

17. The conversion controller circuit of claim 16, wherein:

the low voltage level is a zero voltage level;

when the adjustable output voltage is at the high voltage level, the wireless communication module remains at an active operation mode; and when the adjustable output voltage is at the zero voltage level, the wireless communication module enters into a sleep mode and cease active operation.

18. The conversion controller circuit of claim 15, wherein the conversion controller circuit is configured to operably control the adjustable output voltage to periodically switch between the high voltage level and the low voltage level according to the driving power control command.

19. The conversion controller circuit of claim 13, wherein a lower limit voltage level is required for powering the wireless communication module to remain at an active operation mode; wherein the low voltage level is greater than or equal to the lower limit voltage level and the low voltage level is smaller than the high voltage level.

20. The conversion controller circuit of claim 13, wherein the DC-DC converter circuit includes: a low dropout regulator (LDO) or a switching regulator.

* * * * *